US006995345B2

(12) United States Patent
Gorbold

(10) Patent No.: US 6,995,345 B2
(45) Date of Patent: Feb. 7, 2006

(54) ELECTRODE APPARATUS FOR STRAY FIELD RADIO FREQUENCY HEATING

(75) Inventor: Timothy D. Gorbold, Scottsville, NY (US)

(73) Assignee: Codaco, Inc., Rochester, NY (US)

( * ) Notice: Subject to any disclaimer, the term of this patent is extended or adjusted under 35 U.S.C. 154(b) by 0 days.

(21) Appl. No.: 10/947,349

(22) Filed: Sep. 23, 2004

(65) Prior Publication Data

US 2005/0035117 A1 Feb. 17, 2005

Related U.S. Application Data

(63) Continuation of application No. 10/388,179, filed on Mar. 14, 2003, now Pat. No. 6,812,445.

(60) Provisional application No. 60/365,120, filed on Mar. 19, 2002, provisional application No. 60/364,737, filed on Mar. 18, 2002.

(51) Int. Cl.
*H05B 6/46* (2006.01)
*H05B 6/54* (2006.01)

(52) U.S. Cl. ..... 219/764; 219/770; 219/780; 34/250; 34/255

(58) Field of Classification Search ..... 219/764, 219/770, 780, 774, 778; 34/250, 258, 253–356
See application file for complete search history.

(56) References Cited

U.S. PATENT DOCUMENTS

| | | | | |
|---|---|---|---|---|
| 2,212,522 | A | | 8/1940 | Hart, Jr. et al. |
| 3,329,796 | A | | 7/1967 | Manwaring |
| 3,450,856 | A | | 6/1969 | Buck et al. |
| 3,461,263 | A | | 8/1969 | Manwaring |
| 4,628,168 | A | * | 12/1986 | Nebergall et al. ..... 219/780 |
| 4,638,571 | A | | 1/1987 | Cook |
| 6,617,557 | B1 | | 9/2003 | Ryan et al. |

OTHER PUBLICATIONS

PCT International Search Report from PCT Application No. US03/07937.

* cited by examiner

*Primary Examiner*—Philip H. Leung
(74) *Attorney, Agent, or Firm*—Rothwell, Figg, Ernst & Manbeck

(57) ABSTRACT

An RF heating system for generating precision stray RF fields that can be used to heat materials. The RF heating system includes an RF power supply for generating RF signals and an electrode apparatus that is coupled to the RF power supply. An electrode apparatus according to the present invention has many advantages over existing electrode apparatuses. For example, the electrode apparatus is easier to manufacture, easier to duplicate, easier to control the manufacturing tolerances on the electrode system, and easier to correctly place and design the resulting RF stray field.

53 Claims, 17 Drawing Sheets

ELECTRODE APPARATUS FOR STRAY FIELD RADIO FREQUENCY HEATING

This application is a continuation of U.S. patent application Ser. No. 10/388,179, filed Mar. 14, 2003 now U.S. Pat. No. 6,812,445, which claims the benefit of U.S. Provisional Patent Application No. 60/364,737, filed Mar. 18, 2002, and also claims the benefit of U.S. Provisional Patent Application No. 60/365,120, filed Mar. 19, 2002.

BACKGROUND OF THE INVENTION

1. Field of the Invention

The present invention is related to the field of electrode apparatuses for stray field radio frequency ("RF") heating.

2. Discussion of the Background

A conventional electrode apparatus for stray field heating typically includes at least two parallel electrodes. The electrode apparatus is electrically connected to an RF generator that generates an RF signal. When the RF generator generates an RF signal, an RF field is generated between the two electrodes and a stray RF field is also radiated from the electrodes. The RF field is typically strongest in the region within the overlapping space between the electrodes, with a stray component of the field extending beyond the overlapping area of the electrodes. Stray field RF heating refers to the technique of heating a material by exposing the material to the generated stray field.

SUMMARY OF THE INVENTION

In one aspect, the present invention provides an RF heating system for generating precision stray RF fields that can be used to heat materials. The RF heating system includes an RF power supply for generating RF signals and an electrode apparatus that is coupled to the RF power supply. An electrode apparatus according to the present invention has many advantages over existing electrode apparatuses. For example, the electrode apparatus is easier to manufacture, easier to manufacture duplicate electrode systems, easier to control the manufacturing tolerances on the electrode system, and easier to correctly place and design the resulting RF stray field. Other advantages exist.

According to one embodiment, an electrode apparatus of the present invention comprises two elements: a first element and a second element. The first element and the second element are each energized by a radio frequency signal that is typically at a phase angle of 0° and 180° respectfully, to produce a voltage potential between the electrodes that varies between zero and a maximum potential at the frequency provided by the power supply. In addition, the first element could be energized by a radio frequency signal and the second element could be equivalent to ground, still providing a voltage potential between the electrodes that varies at the frequency of the source supply.

In one embodiment, the first element comprises a first elongated member and a second elongated member. The first element further comprises an elongated electrode having one end connected to the first elongated member and the other end connected to the second elongated member. The elongated members and the elongated electrode are preferably formed from a single mass of material (such as, but not limited to, a copper sheet or plate), but this is not a requirement.

The second element comprises a base and an electrode plate that is connected to and extends outwardly from a surface of the base. The electrode plate is rectangular in shape having two lateral sides and a distal side. Like the first element, the second element is preferably formed from a single mass of material, but this is not a requirement.

The first element and the second element are positioned such that the elongated electrode and the electrode plate are aligned so that, when the RF power supply produces an RF signal, an RF field is generated between the elongated electrode and the electrode plate, and a stray RF field radiates from the elongated electrode and the electrode plate. In one embodiment, the first element and the second element are positioned such that the elongated electrode and the electrode plate are spaced apart and interdigitated or interlaced or "laterally adjacent" such that the elongated electrode is not directly over any portion of the electrode plate. That is, the distal side of the electrode plate runs substantially parallel with the elongated electrode and is spaced apart from the elongated electrode. Preferably, the distance from the top surface of the elongated electrode to the surface of the base is equal to or about equal to the height of the electrode plate, but this is not a requirement.

Advantageously, the first element may include a plurality of elongated electrodes. Each of the plurality of elongated electrodes having one end connected to the first elongated member and the other end connected to the second elongated member. Preferably, the plurality of elongated electrodes are evenly spaced apart and are parallel with each other. In this embodiment, the second element includes a plurality of electrode plates that are attached to and extend outwardly from the surface of the base. Like the elongated electrodes, the electrode plates are also preferably spaced evenly apart. In this embodiment, the first element and the second element are aligned so that the elongated electrodes and the electrode plates are interdigitated. Preferably, the distance from the top surface of an elongated electrode to the surface of the base is equal to or about equal to the height of the electrode plate(s) that are adjacent to the elongated electrode.

In one embodiment, the RF power supply includes an RF generator, an impedance matching circuit and an above described electrode apparatus. In this embodiment, the first element of the electrode apparatus is connected to a first node within the impedance matching circuit and the second element of the electrode apparatus is connected to a second node within the impedance matching circuit. In one embodiment, an element having an inductance (e.g., a conductive coil) is connected between the first node and the second node.

In another embodiment, the second element of the electrode apparatus is placed within a housing and the first element rests on a surface of the housing. The housing is preferably constructed from a non-conducting or low dielectric constant or low dissipation factor material such as, but not limited to Teflon® (polytetraflouroethylene), polypropylene, polyethelene, Kapton®, and polystyrene.

In another aspect, the invention provides an electrode apparatus for generating stray fields that includes an elongated electrode and an electrode plate having a first face and a second face. The first face of the electrode plate faces in a direction that is substantially perpendicular to the longitudinal axis of the elongated electrode. The elongated electrode is spaced apart from the first face of the electrode plate. The height of the electrode plate is greater than the thickness of the elongated electrode. And the length of the electrode plate is shorter than the length of the elongated electrode.

In another aspect, the invention provides a method for making a product, wherein the product has one or more components. The method includes the steps of: generating a stray field using one of the electrode apparatuses described above and exposing a component of the product to the stray field for the purpose of heating the component. The component may be an adhesive that heats when exposed to certain RF fields or any other component.

The above and other features and advantages of the present invention, as well as the structure and operation of preferred embodiments of the present invention, are described in detail below with reference to the accompanying drawings.

BRIEF DESCRIPTION OF THE DRAWINGS

The accompanying drawings, which are incorporated herein and form part of the specification, illustrate various embodiments of the present invention and, together with the description, further serve to explain the principles of the invention and to enable a person skilled in the pertinent art to make and use the invention. In the drawings, like reference numbers indicate identical or functionally similar elements. Additionally, the left-most digit(s) of a reference number identifies the drawing in which the reference number first appears.

DETAILED DESCRIPTION OF THE PREFERRED EMBODIMENTS

While the present invention may be embodied in many different forms, there is described herein in detail an illustrative embodiment with the understanding that the present disclosure is to be considered as an example of the principles of the invention and is not intended to limit the invention to the illustrated embodiment.

Figure 1:
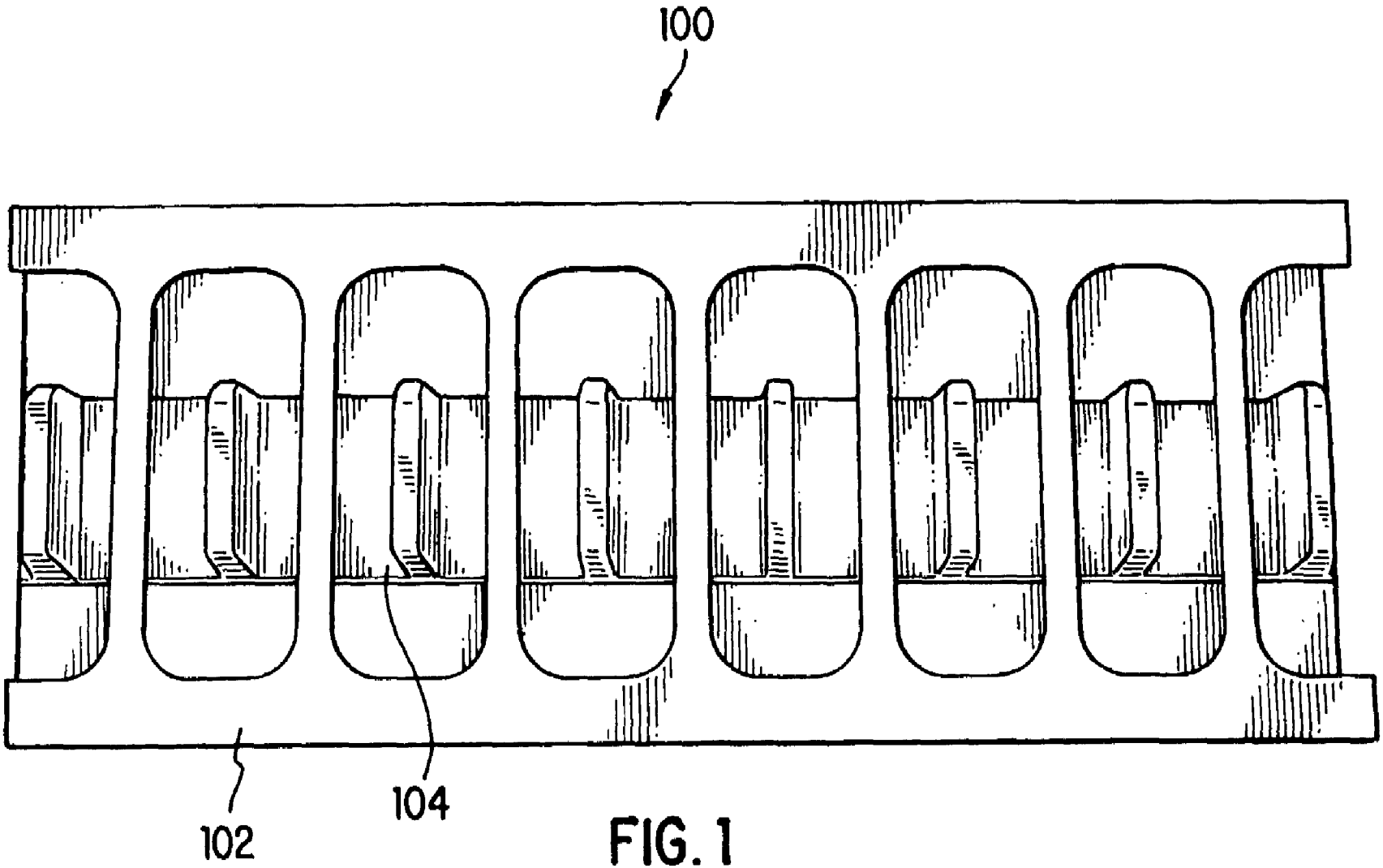
FIG. 1 is a top view of an electrode apparatus according to one embodiment of the invention.
Figure 2:
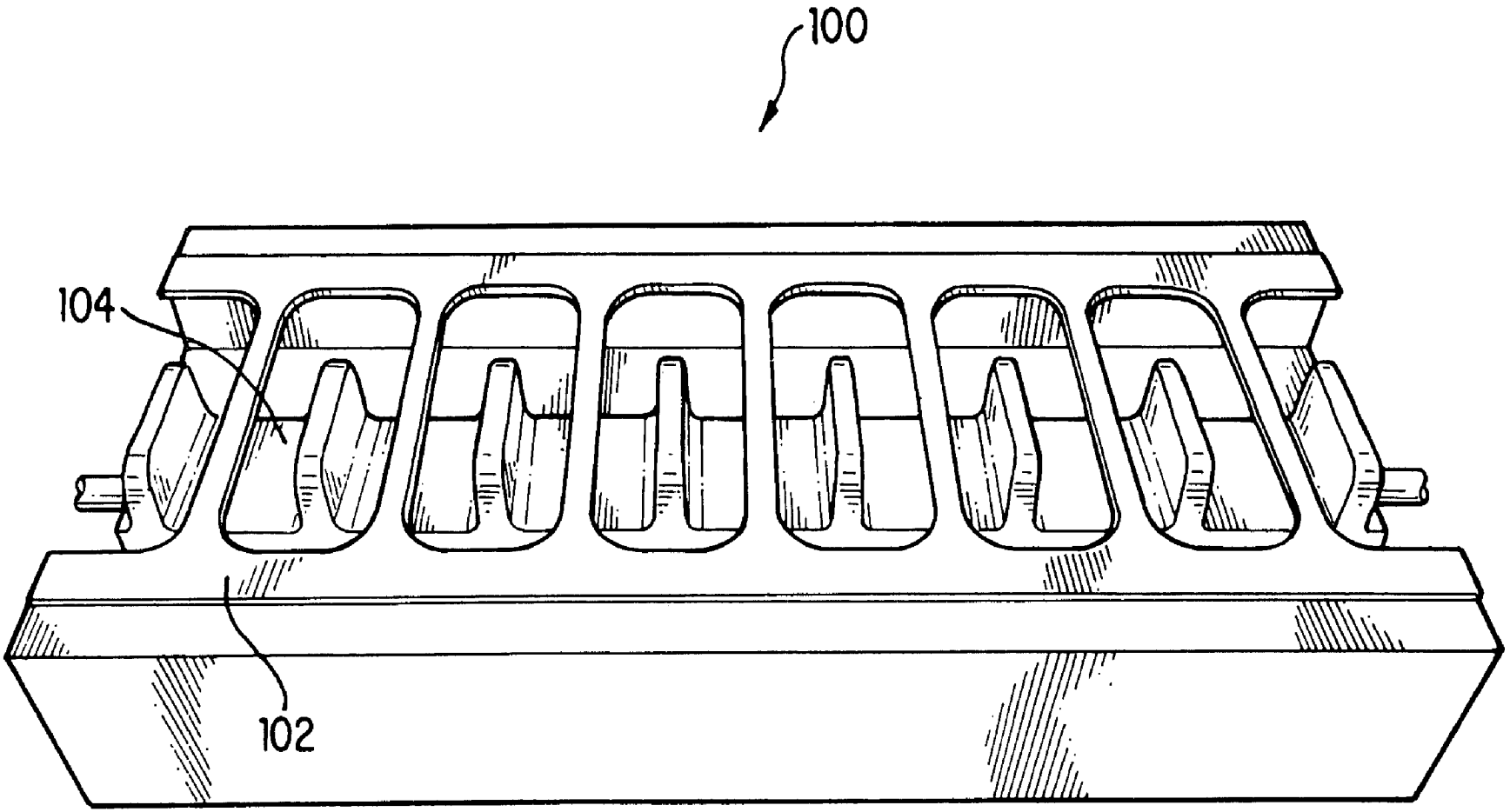
FIG. 2 shows a perspective view of the electrode apparatus.
Figure 3:
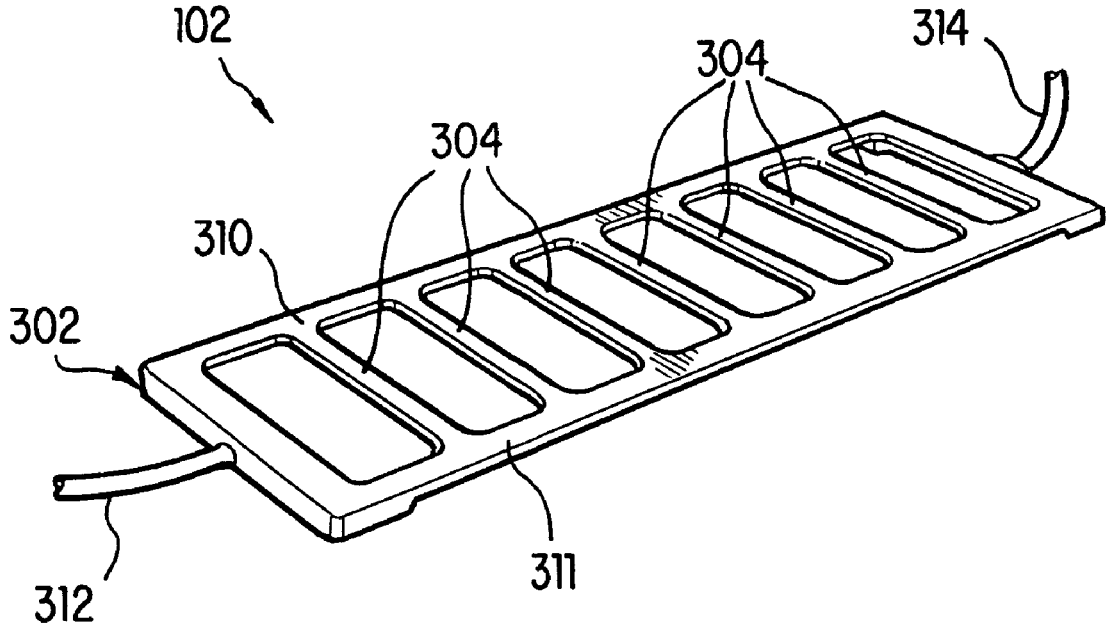
FIG. 3 is a perspective view of a first element of the electrode apparatus.
Figure 4:
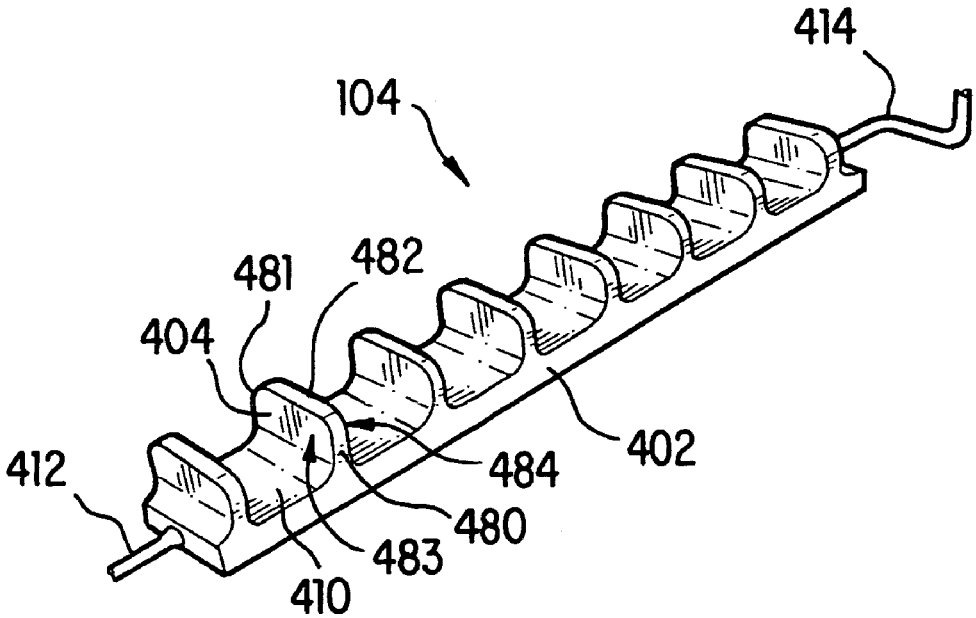
FIG. 4 is perspective view of a second element of the electrode apparatus.
Figure 5A:
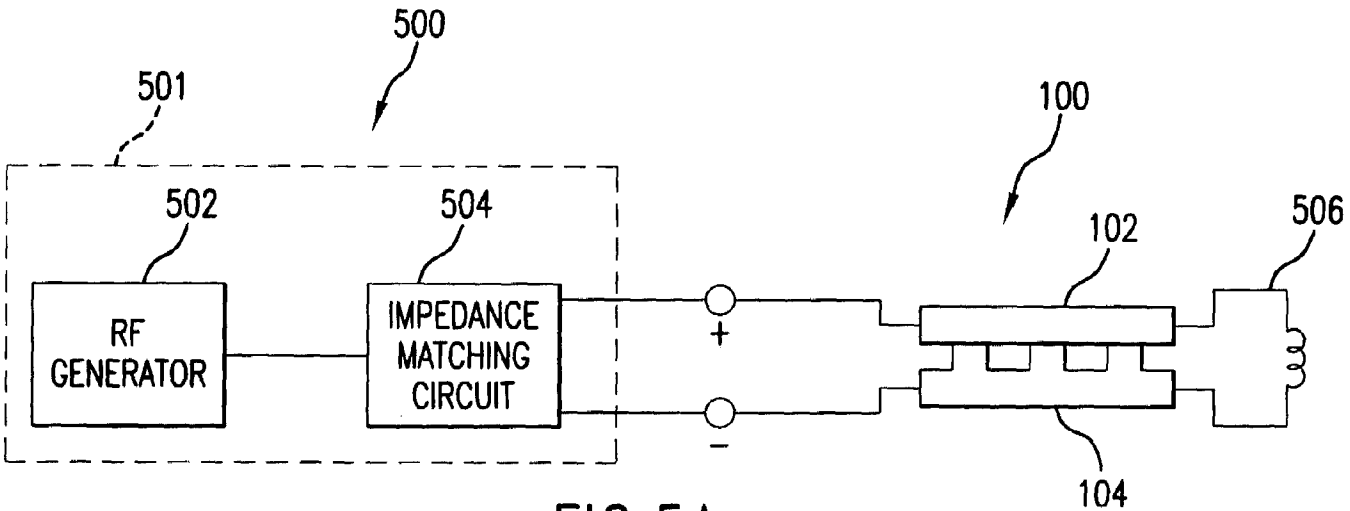
FIG. 5A illustrates an RF heating system.

FIG. 1 is a top view of an electrode apparatus 100, according to one embodiment of the invention, for use in an RF heating system 500 (see FIG. 5A). As shown in FIG. 1, electrode apparatus 100 includes a first element 102 a second element 104. FIG. 2 shows a perspective view of electrode apparatus 100. FIG. 3 is a perspective view of first element 102, and FIG. 4 is perspective view of second element 104.

Referring now to FIG. 5A, RF heating system 500 includes an RF power supply 501 and electrode apparatus 100, which is coupled to RF power supply 501. RF power supply includes an RF generator 502 and may include an impedance matching circuit 504. As shown in FIG. 5, both first element 102 and second element 104 of electrode apparatus 100 are connected to impedance matching circuit 504, which is connected to RF generator 502. When RF generator 502 generates an RF signal a stray RF field is generated by electrode apparatus 100. This stray RF field can be used to heat a material. As shown in FIG. 5, an optional coil 506 may be connected between first element 102 and second element 104 for impedance matching. Coil 506 can be made hollow, thus enabling electrode apparatus 100 to be water cooled.

Figure 5B:
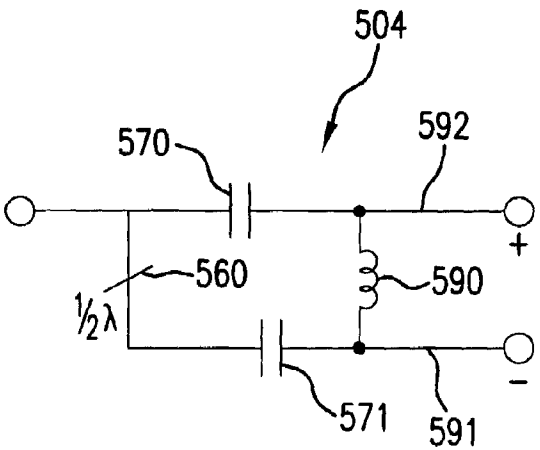
FIG. 5B is a circuit diagram of an impedance matching circuit according to one embodiment.

For illustration, FIG. 5B is a circuit diagram of one possible embodiment of impedance matching circuit 504. As shown in FIG. 5B, circuit 504 includes a transformer 560, a first capacitor 570, a second capacitor 571, an inductor 580 connected between capacitors 570 and 571. In this embodiment, first electrode element 102 may be connected to node 590 and second electrode element 104 may be connected to node 591, or vice-versa.

Referring now to FIG. 3, first element 102 includes a frame 302 and one or more bars 304 that extend from a first lateral member 310 of frame 302 to a second lateral member 311 of frame 302. Frame 302 and bars 304 may be solid or hollow. Bars 304 are referred to herein as "elongated electrodes 304". Frame 302 and elongated electrodes 304 are made from an electrically conductive material or materials (such as, but not limited to, copper). In one embodiment, frame 302 and elongated electrodes 304 are formed from a single body, but this is not a requirement, as elongated electrodes 304 may be connected to lateral members 310 and 311 by, for example, welding, brazing or soldering or other connection technique.

Elongated electrodes 304 are generally of an elongated rectangular or cylindrical shape. If elongated electrodes are rectangular in shape, then, to suppress the potential for arcing, the edges of elongated electrodes 304 may be rounded. The dimensions of frame 302 and elongated electrodes 304 vary depending on the heating application. A first connector 312 is connected to frame 302 and is used to electrically connect frame 302 to an RF power supply. An optional second connector 314 is also connected to frame 302. This connector is used to connect frame 302 to coil 506 or to other circuit elements.

Referring to FIG. 4, second element 104 includes a base 402. Base 402 is made from an electrically conductive material or materials. Second element 104 also includes one or more electrode plates 404. Electrode plates 404 are attached to a top surface 410 of base 402 and extend outwardly from top surface 410. Like base 402, electrode plates 404 are made from an electrically conductive material or materials. In one embodiment, electrode plates 404 are integral with base 402, but this is not a requirement, as electrode plates 404 may be connected to top surface 410 by, for example, welding, brazing or soldering or other connection technique. In one embodiment, electrode plates 404 are generally of a rectangular shape and have a first lateral side 480, a second lateral side 481, a distal side 482, a first face 483 and a second face 484. The specific dimensions of base 402 and electrode plates 404 will vary depending on the heating application. To suppress the potential for arcing, the edges of electrode plates 404 may be rounded. A first connector 412 is connected to base 402 and is used to electrically connect base 402 to an RF power supply. An optional second connector 414 is also connected to base 402. This connector is used to connect base 402 to coil 506 or to other circuit elements.

Figure 6:
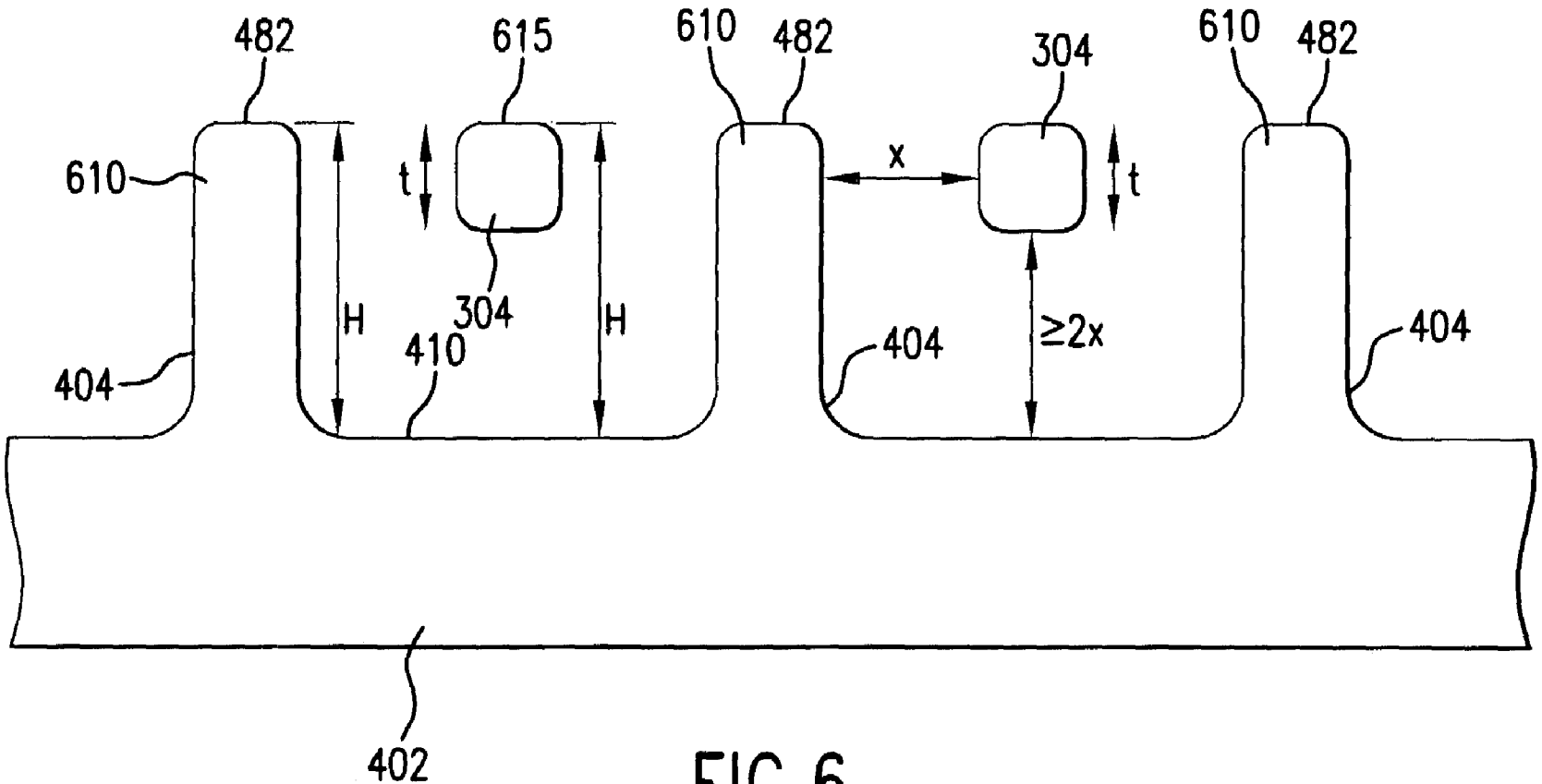
FIG. 6 is a cross-sectional view of the electrode apparatus.

As shown in FIG. 2, first element 102 is spaced apart from top surface 410 of base 402. Preferably, first element 102 and second element 104 are aligned so that elongated electrodes 304 and electrode plates 404 are interdigitated. Additionally, it is preferable that the distance from a top surface 615 of an elongated electrode (see FIG. 6) to top surface 410 of base 402 is equal to or about equal to the height (h) of the electrode plate(s) 404 that are adjacent to the elongated electrode. This is best illustrated in FIG. 6, which illustrates a side cross-sectional view of electrode apparatus 100. As shown in FIG. 6, first element 102 and second element 104 are aligned such that a distal portion 610 of each electrode plate 404 is laterally adjacent to at least one elongated electrode 304.

To avoid potential arcing problems and to concentrate charge density in the area between adjacent distal portions 610 and elongated electrodes 304, the distance from the bottom surface of elongated electrodes 304 to top surface 410 of base 402 should be at least twice the distance (X) from distal portion 610 to elongated electrode 304, but this is not a requirement. Consequently, in one embodiment, the height (h) of electrode plates 404 is greater than the thickness (t) of elongated electrodes 304. In one embodiment, as described above, $h>=t+2X$. Preferably, the distance (X) from the distal portion 610 to the elongated electrode 304 is determined by the specific heating application, thus defining the distance from the bottom surface of elongated electrodes 304 to the top surface 410 of base 402.

Figure 7:
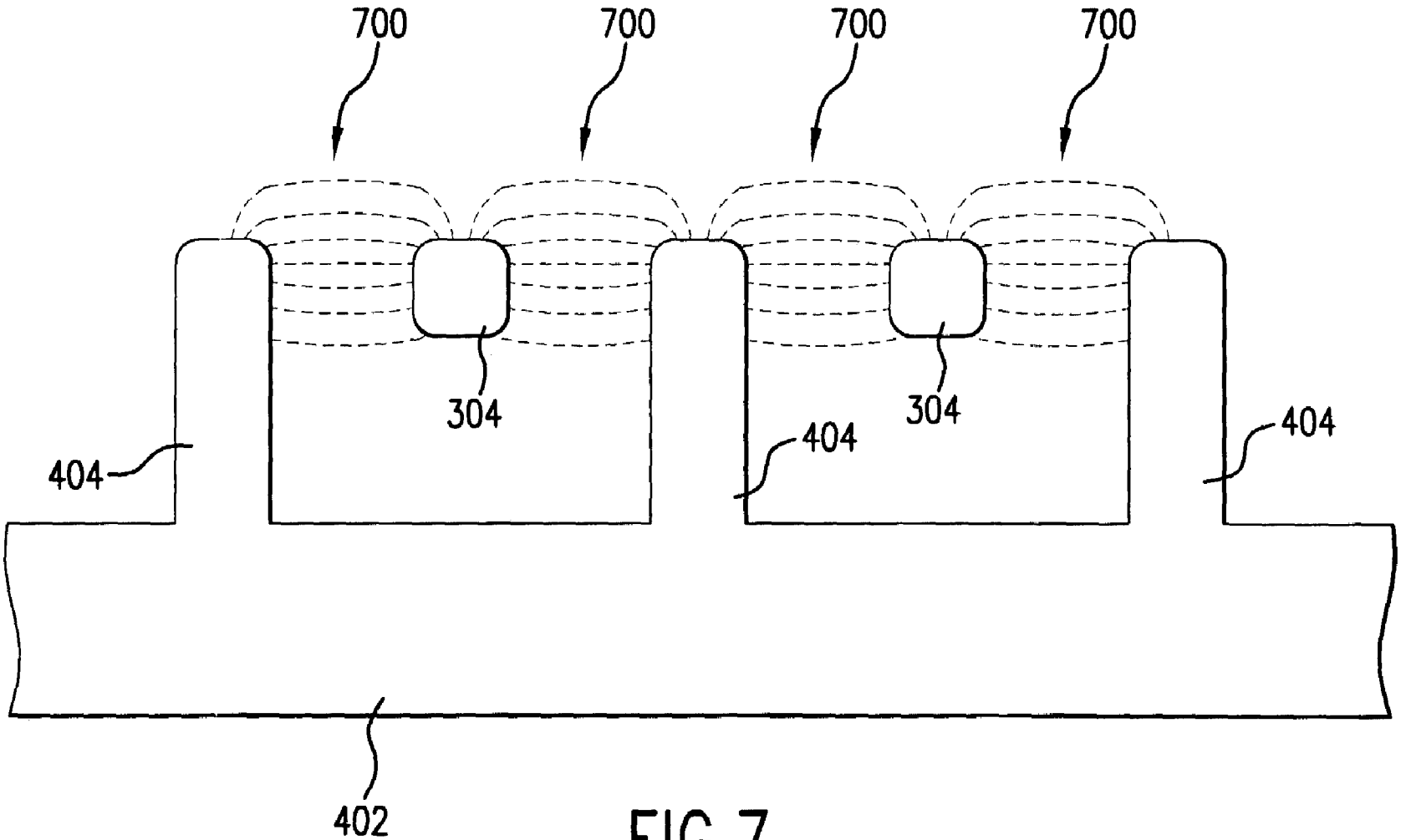
FIG. 7 illustrates a stray RF field.

FIG. 7, like FIG. 6, is a side cross-sectional view of one embodiment of electrode apparatus 100 and illustrates a stray field 700 that is generated when the RF generator generates an RF signal and the RF signal is provided to electrode apparatus 100. As shown in FIG. 7, stray field 700 is created in the region of space that is above the space between distal portion 610 and elongated electrode 304.

Although it is not a requirement, in one embodiment, the following configuration is preferable: electrode plates 404 are spaced evenly apart from each other and all have the same height with respect to top surface 410, first lateral member 310 of frame 302 is parallel with second lateral member 311, and elongated electrodes 304 are perpendicular to both first lateral 310 member and second lateral member 311 and are also spaced evenly apart from each other. The dimensions of base 402, frame 302, electrode plates 404, and elongated electrodes 304 vary depending on the heating application. Thus, there are no preferred dimensions. Similarly, the distance between electrode plates 404 and the distance between elongated electrodes 304 also varies depending on the heating application. However, in one embodiment, it is preferred that the distance between electrode plates 404 is equal to the distance between elongated electrodes 304.

Figure 8:
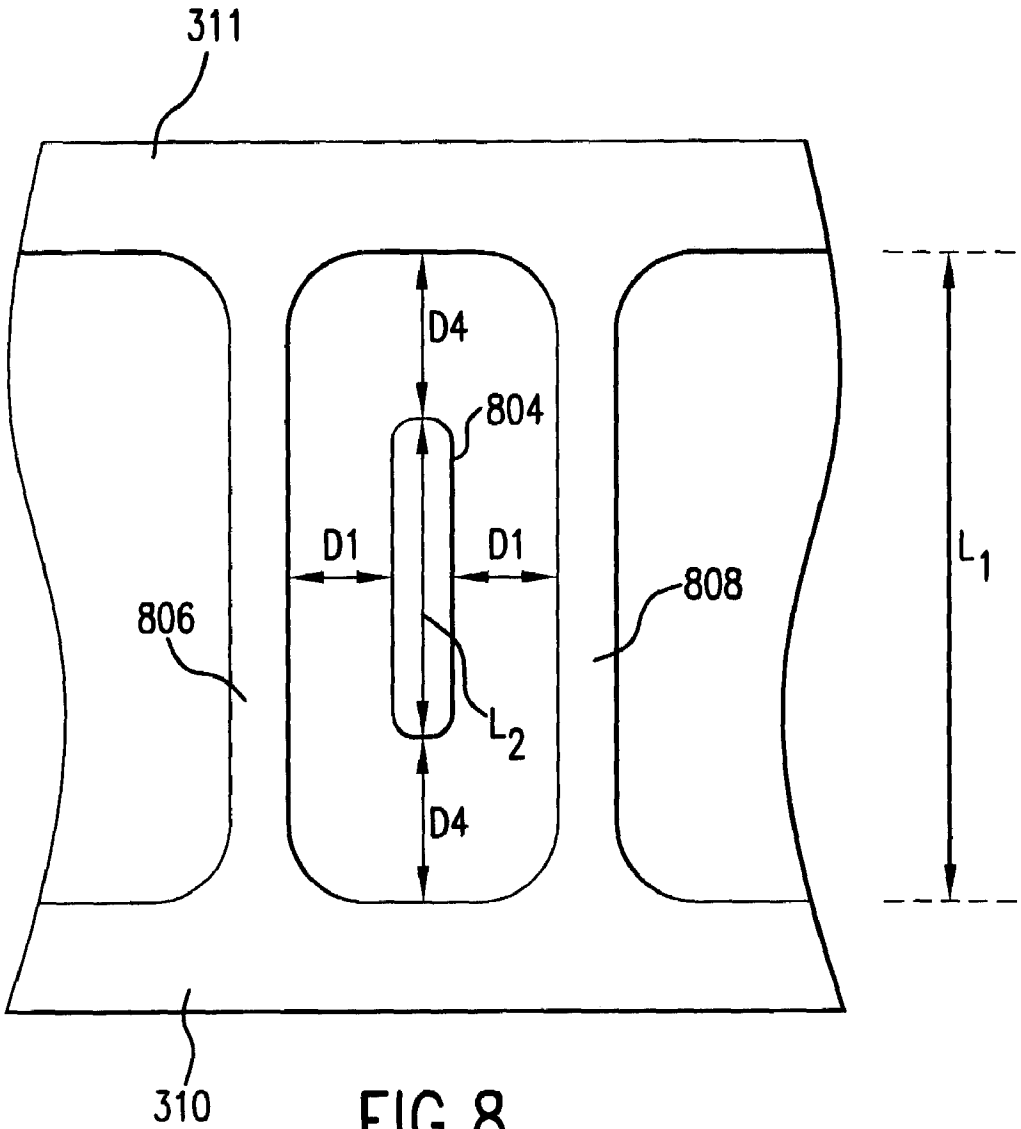
FIG. 8 is a top view of a portion of the electrode apparatus.

FIG. 8 illustrates a top view of a portion of electrode apparatus 100, according to one embodiment, to illustrate preferred relative distances from an electrode plate 804 to its laterally adjacent elongated electrodes 806 and 808 and to lateral members 310 and 311. It is preferred that electrode plate 804 be equally distant (or about equally distant) from elongated electrode 806 and elongated electrode 808. It is also preferred that electrode plate 804 be equally distant (or about equally distant) from lateral member 310 and lateral member 311. Lastly, it is preferred that the distance (D4) from electrode plate 804 to lateral members 310 and 311 be greater than or equal to two times the distance (D1) from electrode plate 804 to an adjacent elongated electrode 806 or 808. Consequently, as shown in FIG. 8, the length (L1) of elongated electrodes 806 and 808 is greater than the length (L2) of electrode plate 804. In one embodiment, as described above, $L1=L2+D4+D4$. It is preferred that the distance (D1) from electrode plate 804 to an adjacent elongated electrode 806 or 808 be determined by the heating application, thus defining the distance (D4) from electrode plate 804 to lateral members 310 and 311.

Figure 9A:
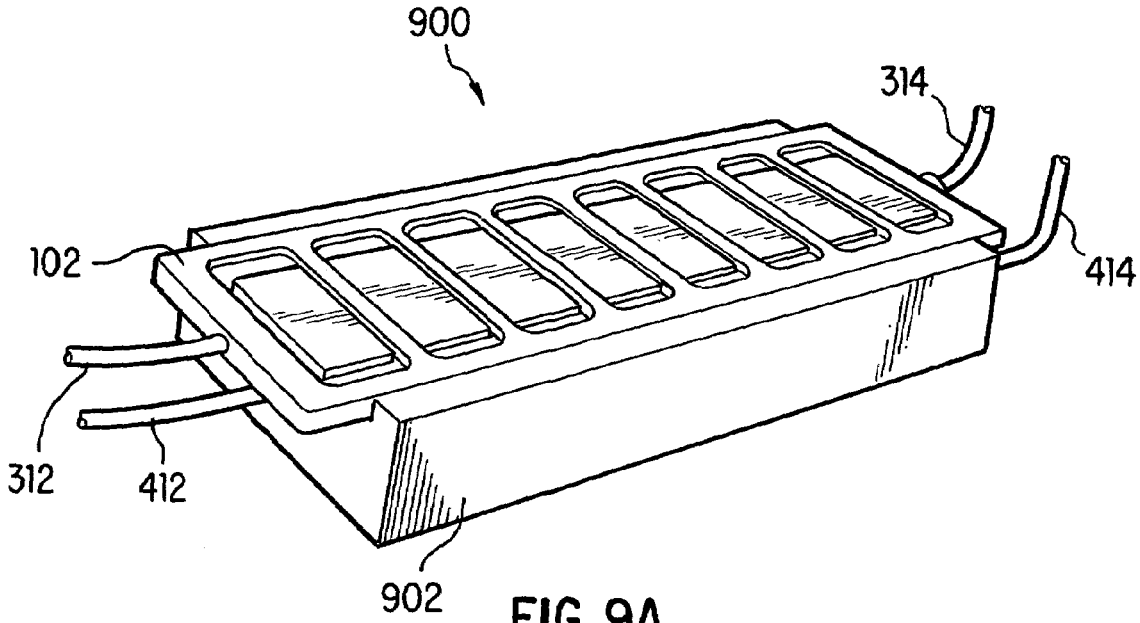
FIG. 9A illustrates one alternative embodiment of an electrode apparatus according to the present invention.

FIG. 9A illustrates an electrode apparatus 900 according to another embodiment of the invention. Electrode apparatus 900 comprises a housing 902 for housing second element 104 of electrode apparatus 100. First element 102 of electrode apparatus 100 rests on (or is secured to) the top of housing 902. The material out of which housing 902 is constructed is preferably a non-electrically conducting material with a low dielectric constant and low dissipation factor, such as, but not limited to Teflon® (polytetraflouroethylene), polypropylene, polyethelene, Kapton®, and polystyrene.

Figure 9B:
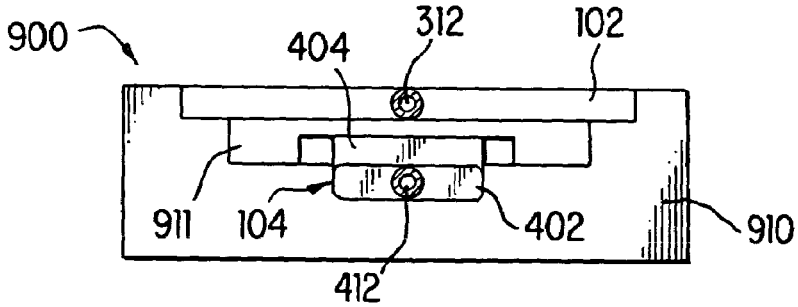
FIG. 9B is a cross-sectional view of the alternative embodiment of the electrode apparatus.
Figure 10:
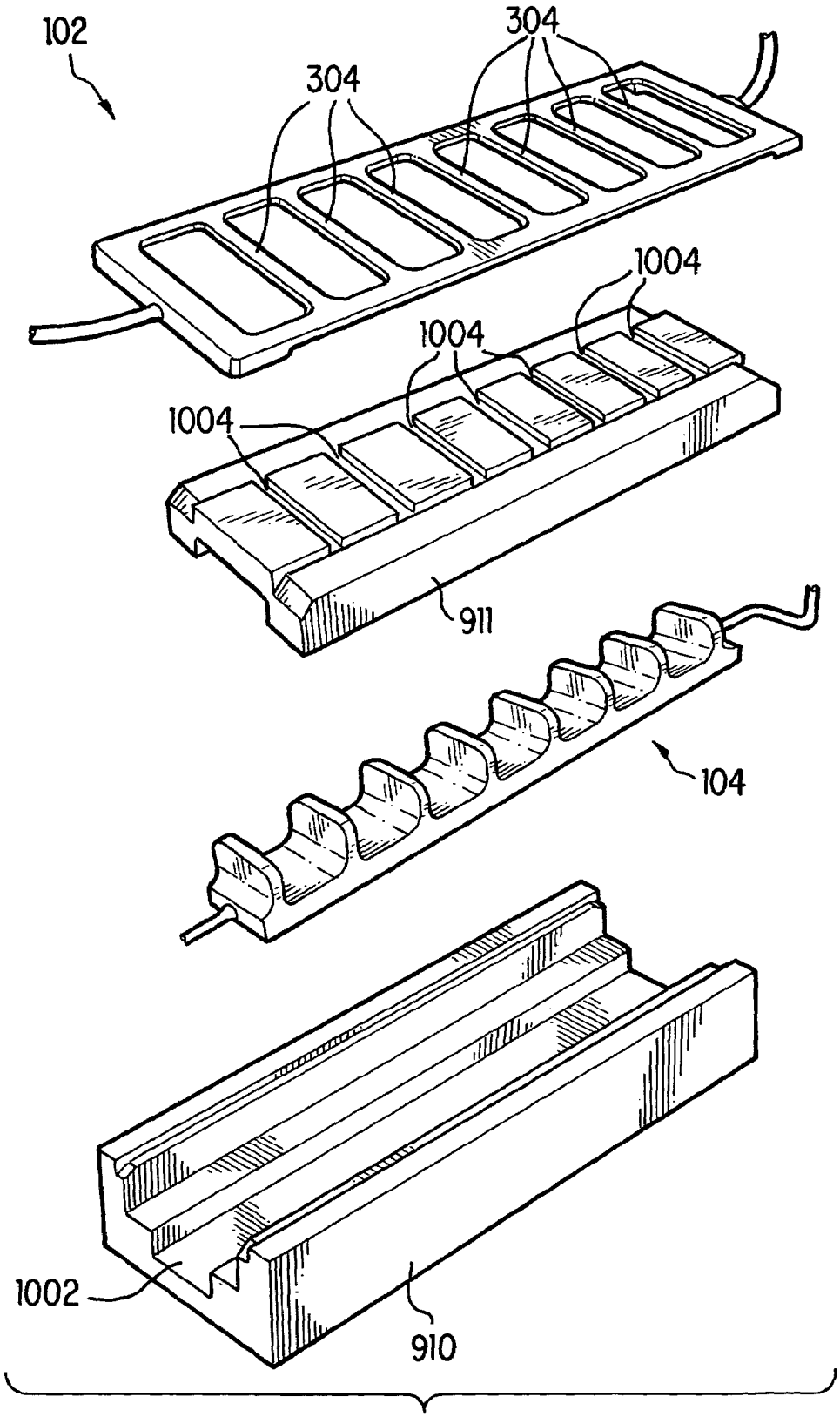
FIG. 10 is an exploded view of the alternative embodiment of the electrode apparatus.

FIG. 9B illustrates an end cross-sectional view of electrode apparatus 900. As shown in FIG. 9B, housing comprises a bottom piece 910 for receiving second element 104 and a cover 911 for covering second element 104. First element 102 may be placed on top of cover 911. FIG. 10 is an exploded view of electrode apparatus 900. As shown in FIG. 10, bottom piece 910 includes a channel 1002 for receiving base 402 of second element 104, and cover 911 includes channels 1004 for receiving elongated electrodes 304.

Figure 11:
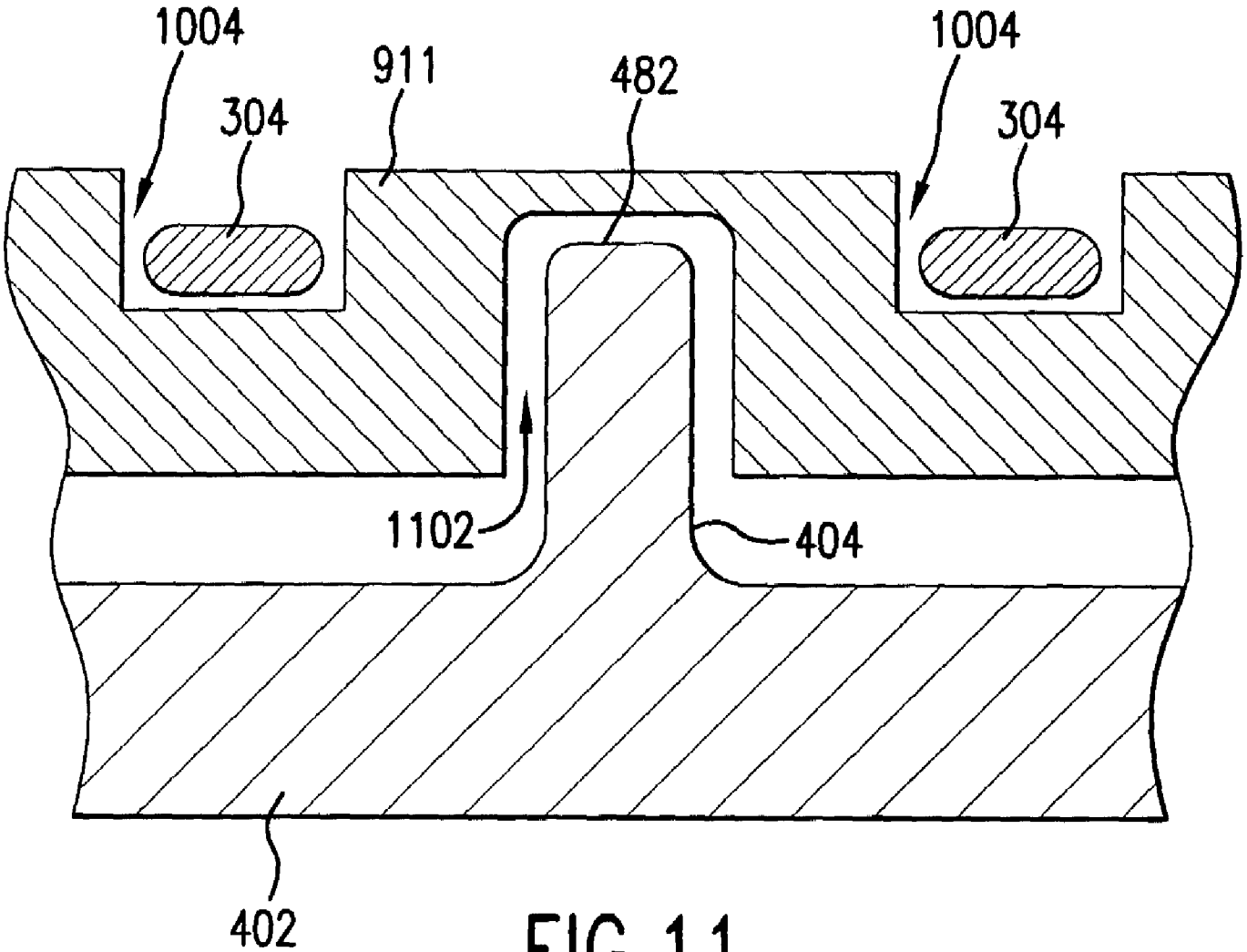
FIG. 11 is another cross-sectional view of the alternative embodiment of the electrode apparatus.

FIG. 11 further illustrates cover 911 according to one embodiment. FIG. 11 is a side cross-sectional view of electrode apparatus 900. As shown in FIG. 11, not only does cover 911 include channels 1004 for receiving elongated electrodes 304, but also includes channels 1102 for receiving distal side 482 of electrode plates 404. Preferably, the thickness of the portion of cover 911 that covers distal side 482 is thin enough so that a stray field radiating from electrode plate 104 can penetrate through cover 911. In one embodiment, the thickness is about 0.05 inches.

Figure 12:
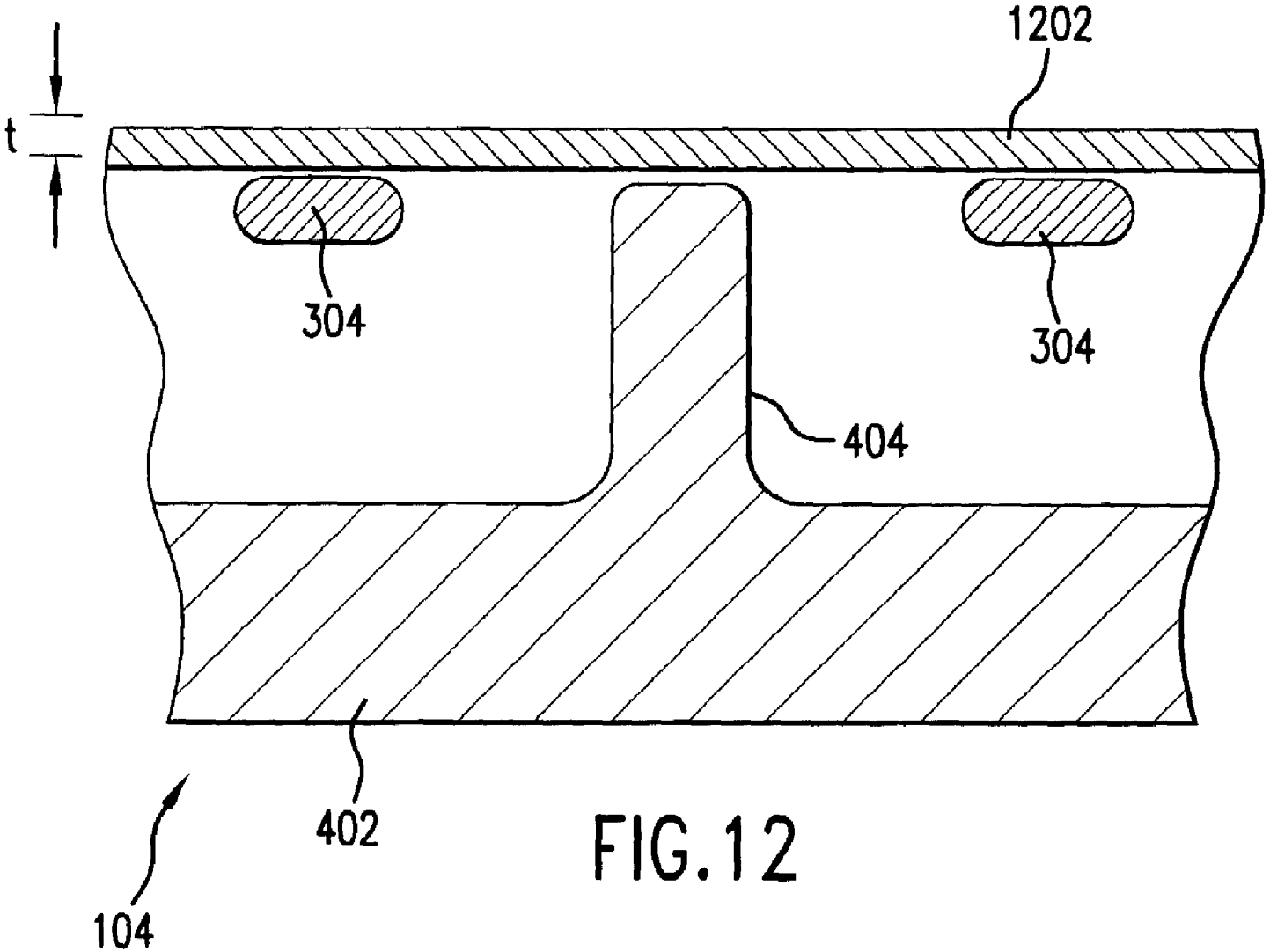
FIG. 12 is a cross-sectional view of another embodiment of an electrode apparatus according to the present invention.
Figure 13:
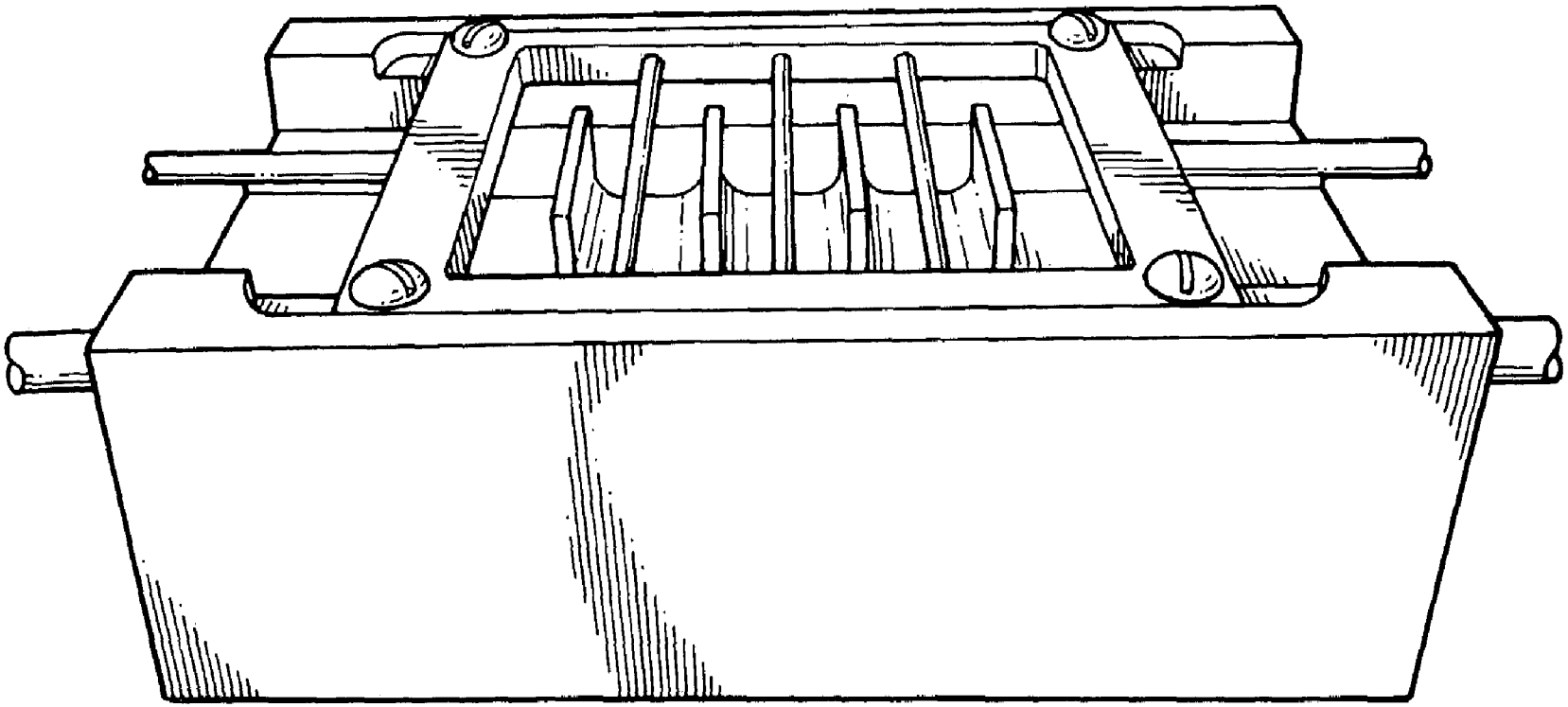
FIGS. 13–18 illustrate additional embodiments of an electrode apparatus according to the present invention.
Figure 14:
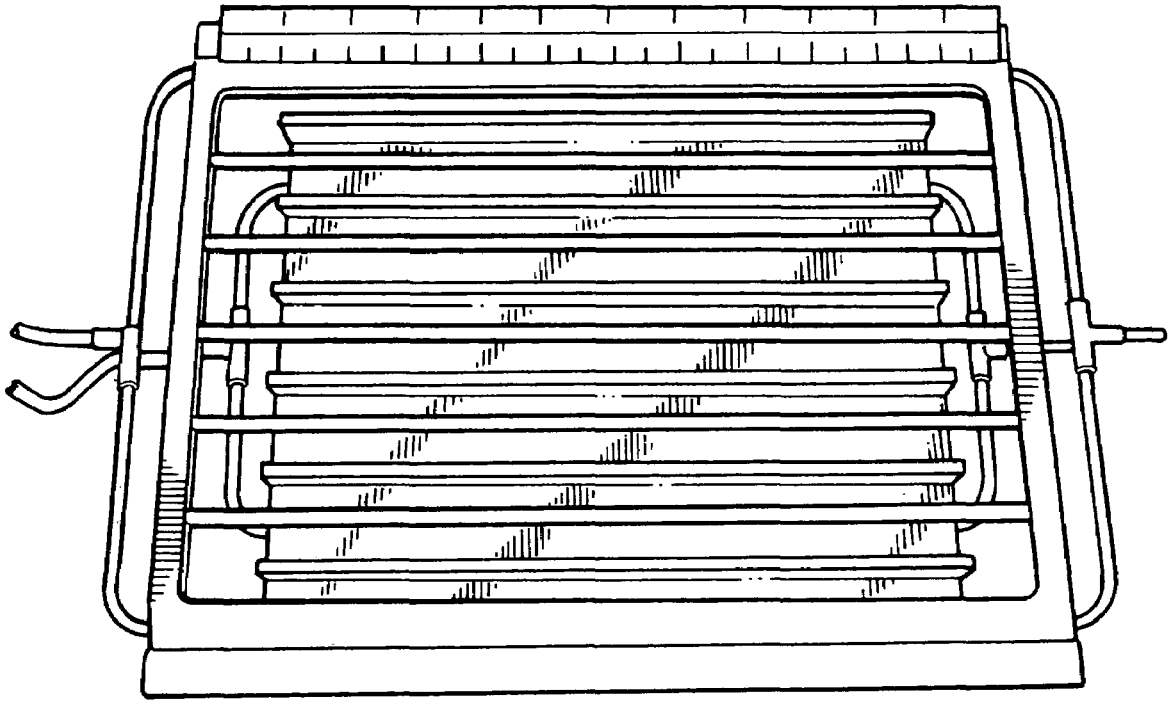
Figure 15:
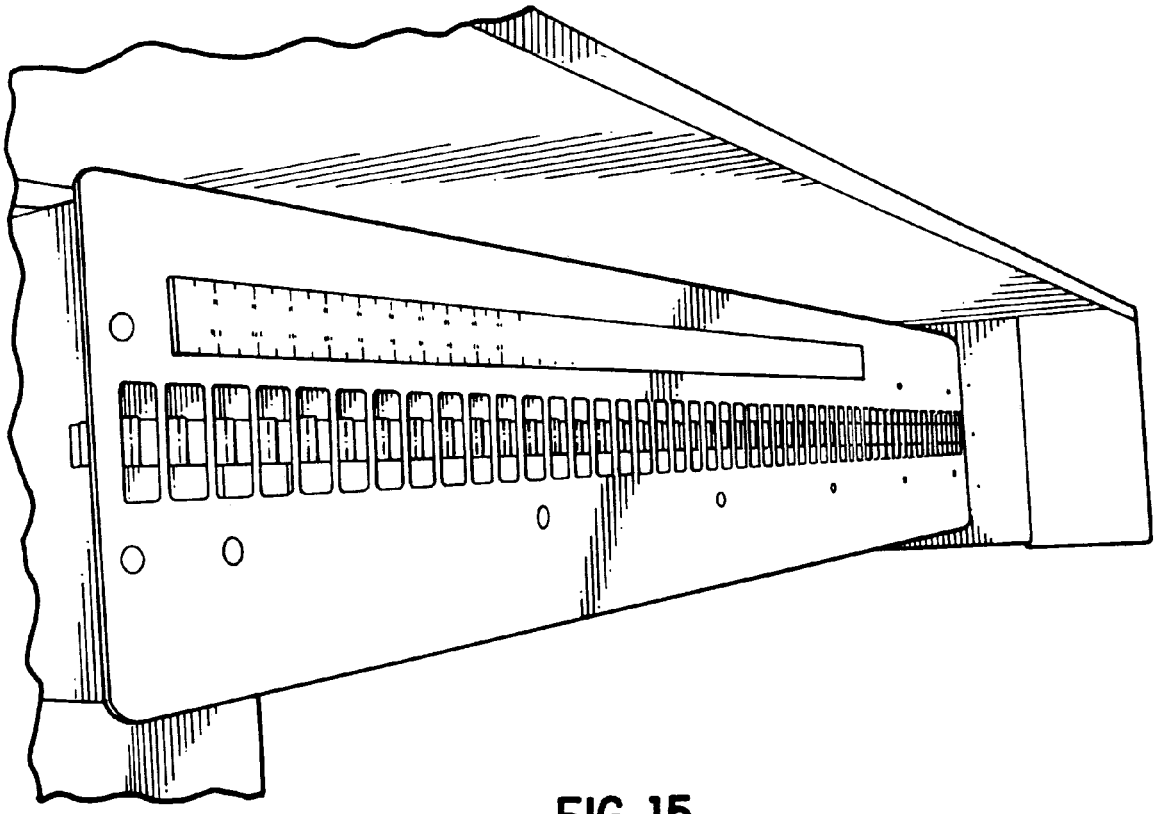
Figure 16:
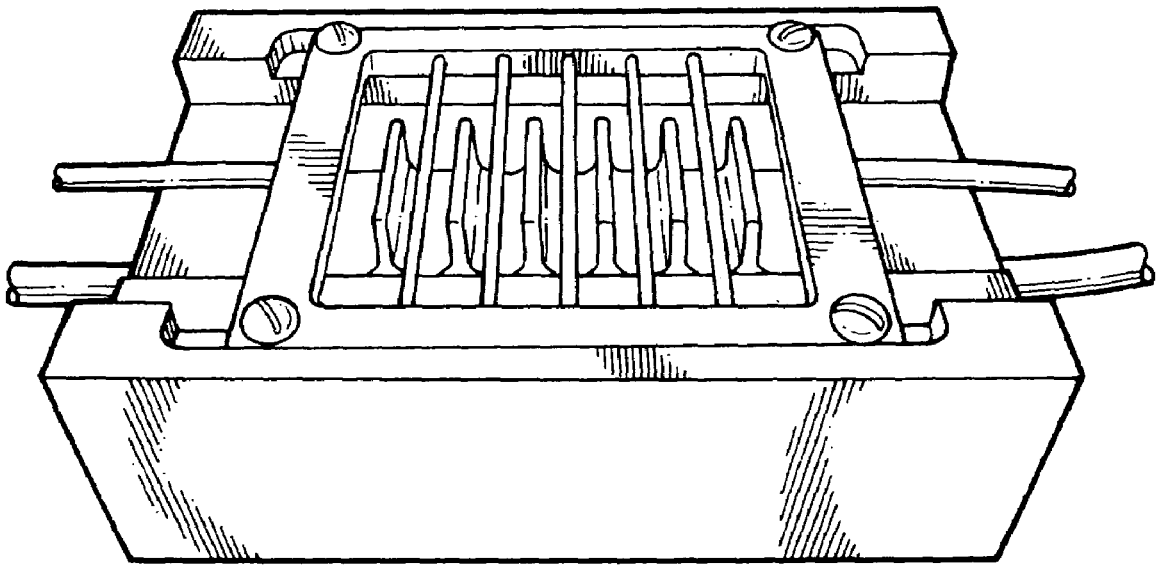
Figure 17:
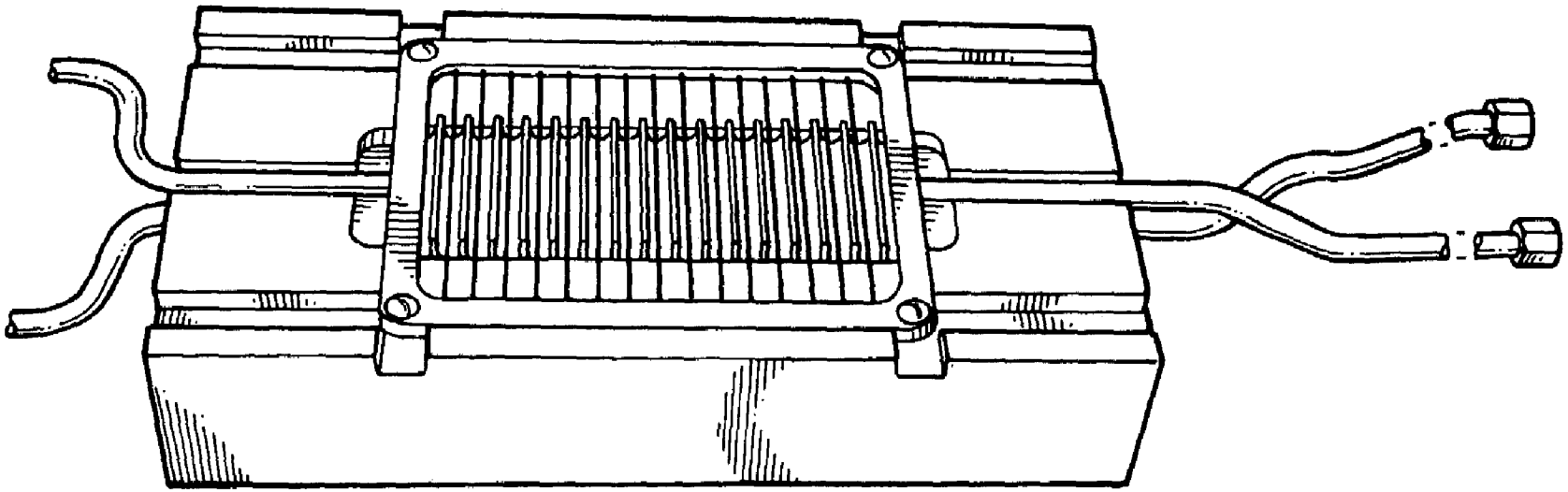
Figure 18:
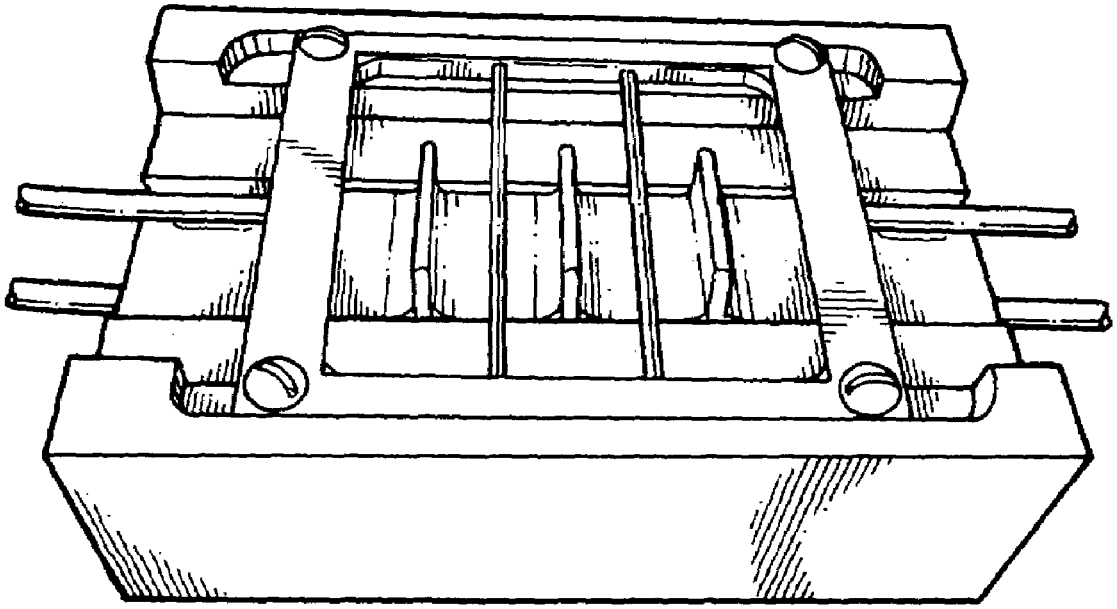

FIG. 12 illustrates a cross-sectional view of an additional embodiment of electrode apparatus 100. In this embodiment, a cover 1202 is used to insulate and protect electrodes 304 and 404. As shown in FIG. 12, it is possible to remove cover 911 from the electrode apparatus assembly 900, and cover element 102 and element 104 with a continuous sheet of material 1202. Preferably, the thickness (t) of the cover sheet 1202 is thin enough so that the stray field can penetrate through the sheet. In addition, the thickness of the cover 1202 is thick enough to act as a focusing material for the stray RF field 700. In one embodiment, the thickness of the cover 1202 is about 0.050 inches, but the invention is not limited to this or any particular thickness. The material out of which cover 1202 is constructed is preferably a non-electrically conducting material with a low dielectric constant and low dissipation factor, such as, but not limited to Teflon® (polytetraflouroethylene), polypropylene, polyethelene, Kapton®, and polystyrene.

To illustrate the some of the possible variations of electrode apparatus 100, FIGS. 13–18 are provided. These figures illustrate just a few of the possible alternative embodiments of the invention.

While various illustrative embodiments of the present invention described above have been presented by way of example only, and not limitation. Thus, the breadth and scope of the present invention should not be limited by any of the above-described exemplary embodiments, but should be defined only in accordance with the following claims and their equivalents.

What is claimed is:

1. An electrode apparatus for generating stray fields, comprising:

a first element; and a second element, wherein the first element comprises an elongated member and an elongated electrode, the elongated electrode having one end connected to the elongated member, the second element comprises a base and an electrode plate that is connected to and extends outwardly from a surface of the base, the first element and the second element are positioned such that (a) the elongated electrode is spaced from a top portion of a face of the electrode plate by a distance of D1, which face faces the elongated electrode, and (b) a bottom surface of the elongated electrode is not directly over a distal side of the electrode plate, but is directly over at least a portion of the base, and the difference between the length of the elongated electrode and the length of the electrode plate is greater than or equal to about 4D1.

2. The electrode apparatus of claim 1, wherein the distance from a top surface of the elongated electrode to the top surface of the base is equal to or about equal to the height of the electrode plate.

3. The electrode apparatus of claim 1, wherein the longitudinal axis of the elongated electrode is perpendicular to the longitudinal axis of the elongated member.

4. The electrode apparatus of claim 1, wherein the second element comprises a plurality of electrode plates, each of said plurality of electrode plates being connected to the surface of the base.

5. The electrode apparatus of claim 1, further comprising a non-electrically conducting solid body placed between the electrode plate and the elongated electrode.

6. The electrode apparatus claim 5, wherein the non-electrically conducting solid body comprises a first channel for receiving the elongated electrode and a second channel for receiving the distal side of the electrode plate.

7. The electrode apparatus of claim 1, further comprising a non-electrically conducting solid body having a channel for receiving the base of the second element.

8. The electrode apparatus of claim 1, wherein the edges of the electrode plate are rounded to suppress the potential for arcing.

9. An RF heating system, comprising:

an RF power supply; and the electrode apparatus according to claim 1 connected to the RF power supply for generating stray RF fields.

10. A method for making a product wherein the product has one or more components, the method comprising:

generating a stray field using the RF heating system of claim 9; and exposing a component of the product to the stray field for the purpose of heating the component.

11. The electrode apparatus of claim 1, further comprising a cover disposed over the elongated electrode and the electrode plate.

12. The electrode apparatus of claim 1, wherein the first element further comprises a second elongated member, and the other end of the elongated electrode is connected to the second elongated member, and wherein the elongated electrode is straight.

13. The electrode apparatus of claim 12, wherein the first element comprises a plurality of elongated electrodes, with each elongated electrode having one end being connected to the first elongated member and the other end being connected to the second elongated member.

14. The electrode apparatus of claim 1, wherein the electrode plate is integral with the base and the elongated electrode is integral with the elongated member.

15. The electrode apparatus of claim 1, wherein the first element is constructed from a single, electrically conductive body.

16. The electrode apparatus of claim 1, wherein the base and the electrode plate are formed from a single body.

17. An electrode apparatus for generating stray fields, comprising:

a first element;

a second element; and a non-electrically conducting solid body, wherein the first element comprises an elongated member and an elongated electrode, the elongated electrode having one end connected to the elongated member, the second element comprises a base and an electrode plate that is connected to and extends outwardly from a surface of the base, the first element and the second element are positioned such that (a) the elongated electrode is spaced from a top portion of a face of the electrode plate, which face faces the elongated electrode, and (b) a bottom surface of the elongated electrode is not directly over a distal side of the electrode plate, but is directly over at least a portion of the base, the non-electrically conducting solid body is placed between the first element and the second element, and the non-electrically conducting solid body comprises a first channel for receiving the elongated electrode and a second channel for receiving the distal side of the electrode plate.

18. The electrode apparatus of claim 17, wherein the distance from a top surface of the elongated electrode to the top surface of the base is equal to or about equal to the height of the electrode plate.

19. The electrode apparatus of claim 17, wherein the longitudinal axis of the elongated electrode is perpendicular to the longitudinal axis of the elongated member.

20. The electrode apparatus of claim 17, wherein the second element comprises a plurality of electrode plates, each of said plurality of electrode plates being connected to the surface of the base.

21. The electrode apparatus of claim 17, wherein the first element is constructed from a single, electrically conductive body.

22. The electrode apparatus of claim 17, further comprising a non-electrically conducting solid body having a channel for receiving the base of the second element.

23. The electrode apparatus of claim 17, wherein the edges of the electrode plate are rounded to suppress the potential for arcing.

24. An RF heating system, comprising:

an RF power supply; and the electrode apparatus according to claim 17 connected to the RF power supply for generating stray RF fields.

25. A method for making a product wherein the product has one or more components, the method comprising:

generating a stray field using the RF heating system of claim 24; and exposing a component of the product to the stray field for the purpose of heating the component.

26. An electrode apparatus for generating stray fields, comprising:

a first element; and a second element, wherein the first element comprises (a) a first elongated member, (b) a second elongated member parallel with and spaced apart from the first elongated member, and (c) a plurality of spaced apart elongated electrodes, each of the plurality of elongated electrodes having a first end fixed to the first elongated member and a second end fixed to the second elongated member, and each of the plurality of elongated electrodes being substantially straight, the second element comprises a base and a plurality of electrode plates, each of the plurality of electrode plates being fixed to and extending outwardly from a surface of the base, and the first element and the second element are positioned such that (a) each of said plurality of elongated electrodes is spaced from a top portion of a face of one of said plurality of electrode plates, which face faces the elongated electrode, and (b) a bottom surface of each of said plurality of elongated electrodes is not directly over any one of said plurality of electrode plates, but is directly over at least a portion of the base.

27. The electrode apparatus of claim 26, further comprising a cover disposed over the first element.

28. The electrode apparatus of claim 26, wherein each said electrode plate is integral with the base and each said elongated electrode is integral with both elongated members.

29. The electrode apparatus of claim 26, wherein the first element is constructed from a single, electrically conductive body.

30. The electrode apparatus of claim 26, wherein the base and the electrode plates are formed from a single body.

31. The electrode apparatus of claim 26, wherein the distal side of the electrode plates run parallel with the elongated electrodes.

32. The electrode apparatus of claim 26, wherein, for each said elongated electrode, the distance from a top surface of the elongated electrode to the top surface of the base is equal to or about equal to the height of an electrode plate disposed adjacent the elongated electrode.

33. The electrode apparatus of claim 26, wherein, for each said elongated electrode, the longitudinal axis of the elongated electrode is perpendicular to the longitudinal axis of the elongated member.

34. The electrode apparatus of claim 26, further comprising a non-electrically conducting solid body placed between the first element and the second element.

35. The electrode apparatus claim 34, wherein the non-electrically conducting solid body comprises a first plurality of channels for receiving the elongated electrodes and a second plurality channel for receiving the distal side of the electrode plates.

36. The electrode apparatus of claim 26, further comprising a non-electrically conducting solid body having a channel for receiving the base of the second element.

37. The electrode apparatus of claim 26, wherein the edges of the electrode plates are rounded to suppress the potential for arcing.

38. An RF heating system, comprising:

an RF power supply; and the electrode apparatus according to claim 26 connected to the RF power supply for generating stray RF fields.

39. A method for making a product wherein the product has one or more components, the method comprising:

generating a stray field using the RF heating system of claim 38; and exposing a component of the product to the stray field for the purpose of heating the component.

40. The electrode apparatus of claim 26, wherein:

the first element and the second element are positioned such that each said elongated electrode is spaced from a top portion of a face of an adjacent electrode plate by a distance of D1, and, for each said elongated electrode-electrode plate pair, the difference between the length of the elongated electrode and the length of the electrode plate is greater than or equal to about 4D1.

41. An electrode apparatus for generating stray fields, comprising:

a first element;

a second element; and a non-electrically conducting solid body, wherein the first element comprises an elongated member and an elongated electrode, the elongated electrode having one end connected to the elongated member, the second element comprises a base and an electrode plate that is connected to and extends outwardly from a surface of the base, the first element and the second element are positioned such that (a) the elongated electrode is spaced from a top portion of a face of the electrode plate, which face faces the elongated electrode, and (b) a bottom surface of the elongated electrode is not directly over a distal side of the electrode plate, but is directly over at least a portion of the base, and the non-electrically conducting solid body has a channel receiving the base of the second element.

42. The electrode apparatus of claim 41, further comprising a cover disposed over the elongated electrode and the electrode plate.

43. The electrode apparatus of claim 41, wherein the distal side of the electrode plate runs parallel with the elongated electrode.

44. The electrode apparatus of claim 41, wherein the distance from a top surface of the elongated electrode to the top surface of the base is equal to or about equal to the height of the electrode plate.

45. The electrode apparatus of claim 41, wherein the first element further comprises a second elongated member, and the other end of the elongated electrode is connected to the second elongated member.

46. The electrode apparatus of claim 45, wherein the first element comprises a plurality of elongated electrodes, with each elongated electrode having one end being connected to the first elongated member and the other end being connected to the second elongated member.

47. The electrode apparatus of claim 41, wherein the electrode plate is integral with the base and the elongated electrode is integral with the elongated member.

48. The electrode apparatus of claim 41, wherein the first element is constructed from a single, electrically conductive body.

49. The electrode apparatus of claim 41, wherein the edges of the electrode plate are rounded to suppress the potential for arcing.

50. The electrode apparatus of claim 41, wherein the base and the electrode plate are formed from a single body.

51. An RF heating system, comprising:

an RF power supply; and the electrode apparatus according to claim 41 connected to the RF power supply for generating stray RF fields.

52. A method for making a product wherein the product has one or more components, the method comprising:

generating a stray field using the RF heating system of claim 51; and exposing a component of the product to the stray field for the purpose of heating the component.

53. The electrode apparatus of claim 41, wherein the longitudinal axis of the elongated electrode is perpendicular to the longitudinal axis of the elongated member and the elongated electrode is coplanar with the elongated member.

* * * * *